US007938672B2

(12) United States Patent
Zhu

(10) Patent No.: US 7,938,672 B2
(45) Date of Patent: May 10, 2011

(54) ELECTRICAL CONNECTOR HAVING RAMP ARRANGED IN PASSAGEWAY LIFTING DOWNWARD-TILTED CONTACT TIP

(75) Inventor: Yu Zhu, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/763,150

(22) Filed: Apr. 19, 2010

(65) Prior Publication Data

US 2011/0039441 A1 Feb. 17, 2011

(51) Int. Cl.
*H01R 13/627* (2006.01)

(52) U.S. Cl. ..... 439/374

(58) Field of Classification Search ..... 439/374, 439/329, 941, 567, 569
See application file for complete search history.

(56) References Cited

U.S. PATENT DOCUMENTS 6,648,682 B1 * 11/2003 Wu ..... 439/567
7,485,009 B1 * 2/2009 Zhu ..... 439/660
7,497,701 B2 * 3/2009 Zhu et al. ..... 439/79
7,837,492 B2 * 11/2010 Zhu ..... 439/329
2002/0076988 A1 * 6/2002 Chang et al. ..... 439/676
2005/0142949 A1 * 6/2005 Fang et al. ..... 439/630
2006/0141845 A1 * 6/2006 Hu et al. ..... 439/350

FOREIGN PATENT DOCUMENTS

TW M348393 1/2009

* cited by examiner

*Primary Examiner* — Jean F Duverne
(74) *Attorney, Agent, or Firm* — Wei Te Chung; Andrew C. Cheng; Ming Chieh Chang

(57) ABSTRACT

An electrical connector includes a plurality of terminals and an insulating housing retained said plurality of terminals. Each terminal includes a retaining portion and a plane contacting portion. The contacting portion has a pre-folded line along which a front end of the contacting portion slants. The insulating housing includes a base portion, a tongue portion extending forward from the base portion and passageways extending in the base portion and the tongue portion to receive the terminals. Each passageway defines a first supporting surface to sustain the front end of the terminal and a second supporting surface to sustain the retained portion of the terminal. A room is defined between said two supporting surface along a rear-to-front direction to accommodate the front ends of the terminals during insertion of the terminal to the passageway.

2 Claims, 8 Drawing Sheets

ELECTRICAL CONNECTOR HAVING RAMP ARRANGED IN PASSAGEWAY LIFTING DOWNWARD-TILTED CONTACT TIP

BACKGROUND OF THE INVENTION

1. Field of the Invention

The present invention relates to an electrical connector, and more particularly to an electrical connector having a ramp arranged in a passageway thereof to lift a downward-tilted contact tip so as to avoid prying-up of the contact tip during mating with a corresponding connector.

2. Description of Related Art

Taiwan Utility Pat. No. M348393 issued on Jan. 1, 2009 to CEN LINK CO., LTD disclosed an electrical connector, which has board tongue portion and a plurality of terminals with a plane contacting portion inserted in the passageways on the tongue portion. The front portion of each terminal bends downwards with a slight angle along a pre-folded line to avoid the upturn of the front end of the contacting portion. Thus the front ends of the contacting portions hide in the passageways to avoid scratching the counter connector when inserted into the electrical connector. However, the downward front end of the contacting portion will scratch the inner bottom face of the passageway during the terminals are inserted into the passageways.

It is thus desired to provide an electrical connector to overcome the disadvantage of the related art.

SUMMARY OF THE INVENTION

Accordingly, an object of the present invention is to provide an electrical connector which decreases the scrape of the terminals to the terminal passageways during insertion of the terminals to the passageways.

In order to achieve the above-mentioned object, an electrical connector comprises a plurality of terminals and an insulating housing retained said plurality of terminals. Each terminal comprises a retaining portion and a plane contacting portion. The contacting portion has a pre-folded line along which a front end of the contacting portion slants. The insulating housing comprises a base portion, a tongue portion extending forward from the base portion and passageways extending in the base portion and the tongue portion to receive the terminals. Each passageway defines a first supporting surface to sustain the front end of the terminal and a second supporting surface to sustain the retained portion of the terminal. A room is defined between said two supporting surface along a rear-to-front direction to accommodate the front ends of the terminals during the insertion of the terminal to the passageway.

Other objects, advantages and novel features of the present invention will become more apparent from the following detailed description of the present embodiment when taken in conjunction with the accompanying drawings.

DETAILED DESCRIPTION OF THE INVENTION

The present invention will now be described in detail with reference to a preferred embodiment thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps have not been described in detail in order to not unnecessarily obscure the present invention.

Figure 1:
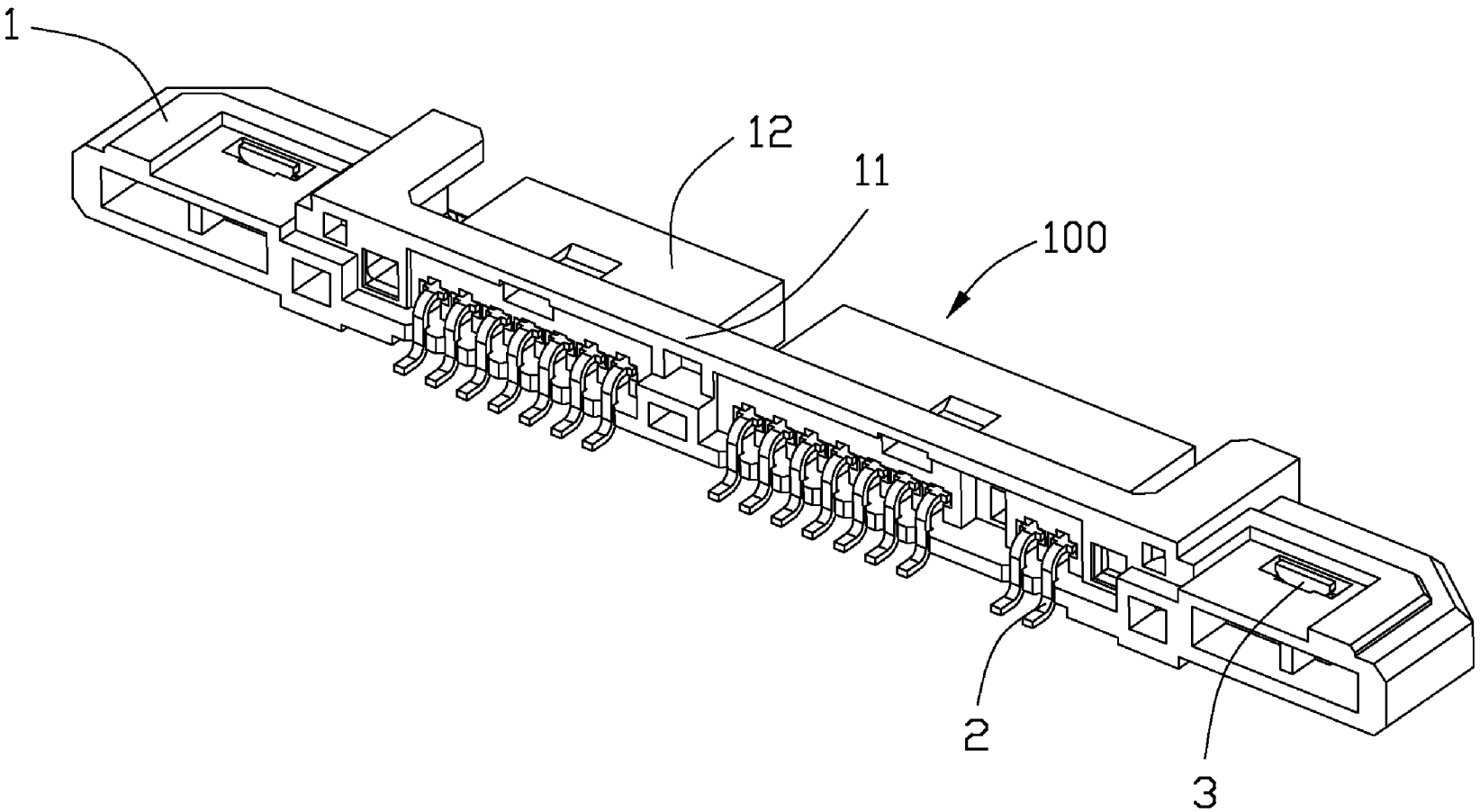
FIG. 1 is a top and rear perspective view of an electrical connector according to an embodiment of the present invention.
Figure 2:
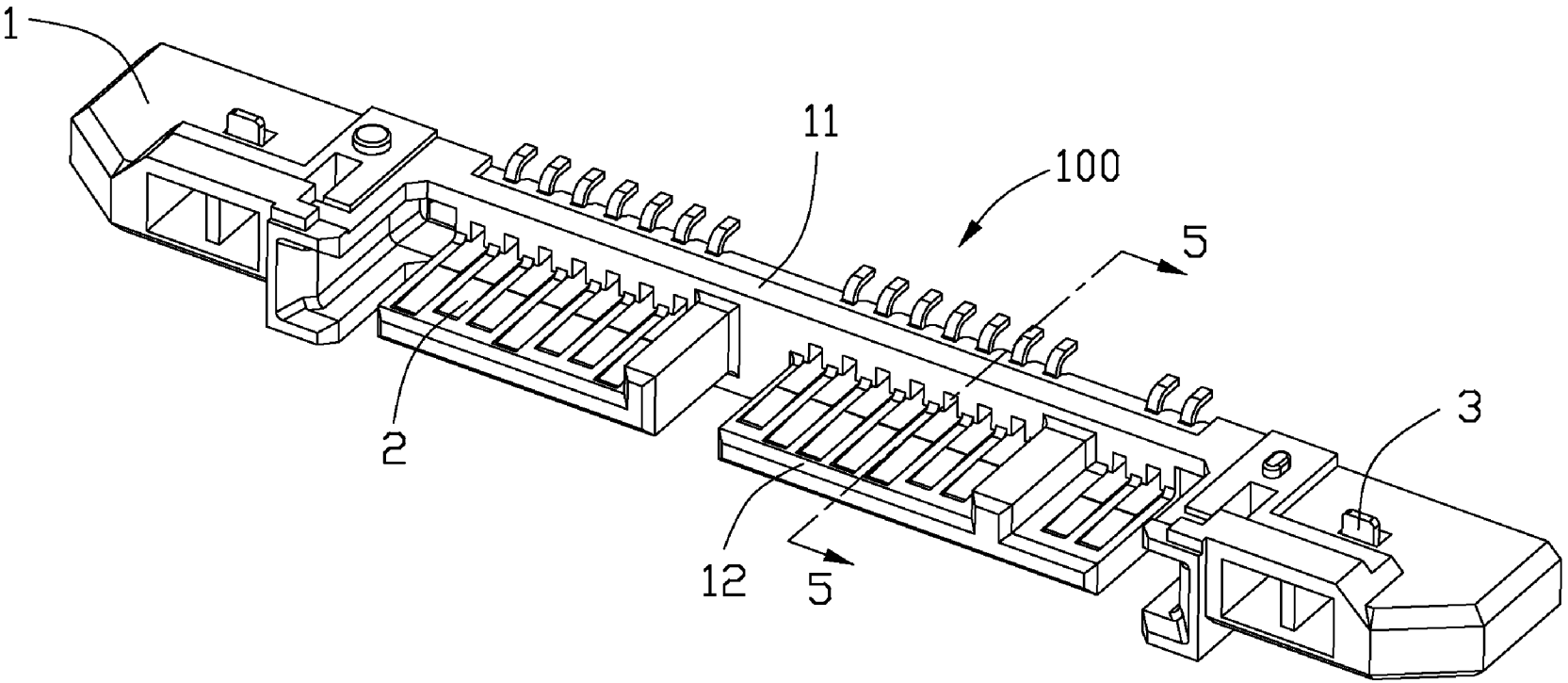
FIG. 2 is a bottom and front perspective view of the electrical connector shown in FIG. 1.
Figure 3:
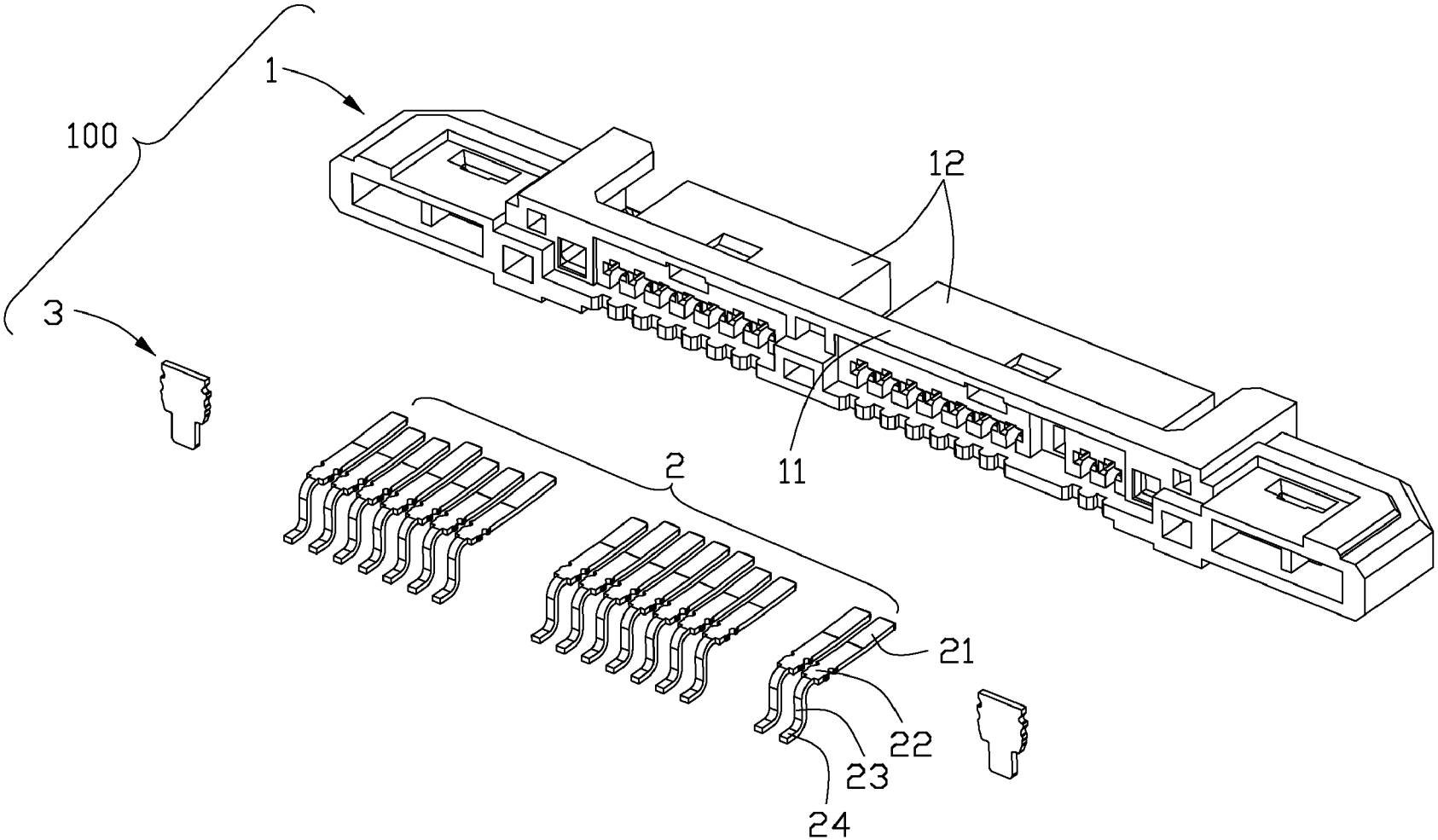
FIG. 3 is an exploded, perspective view of the electrical connector of FIG. 1.
Figure 4:
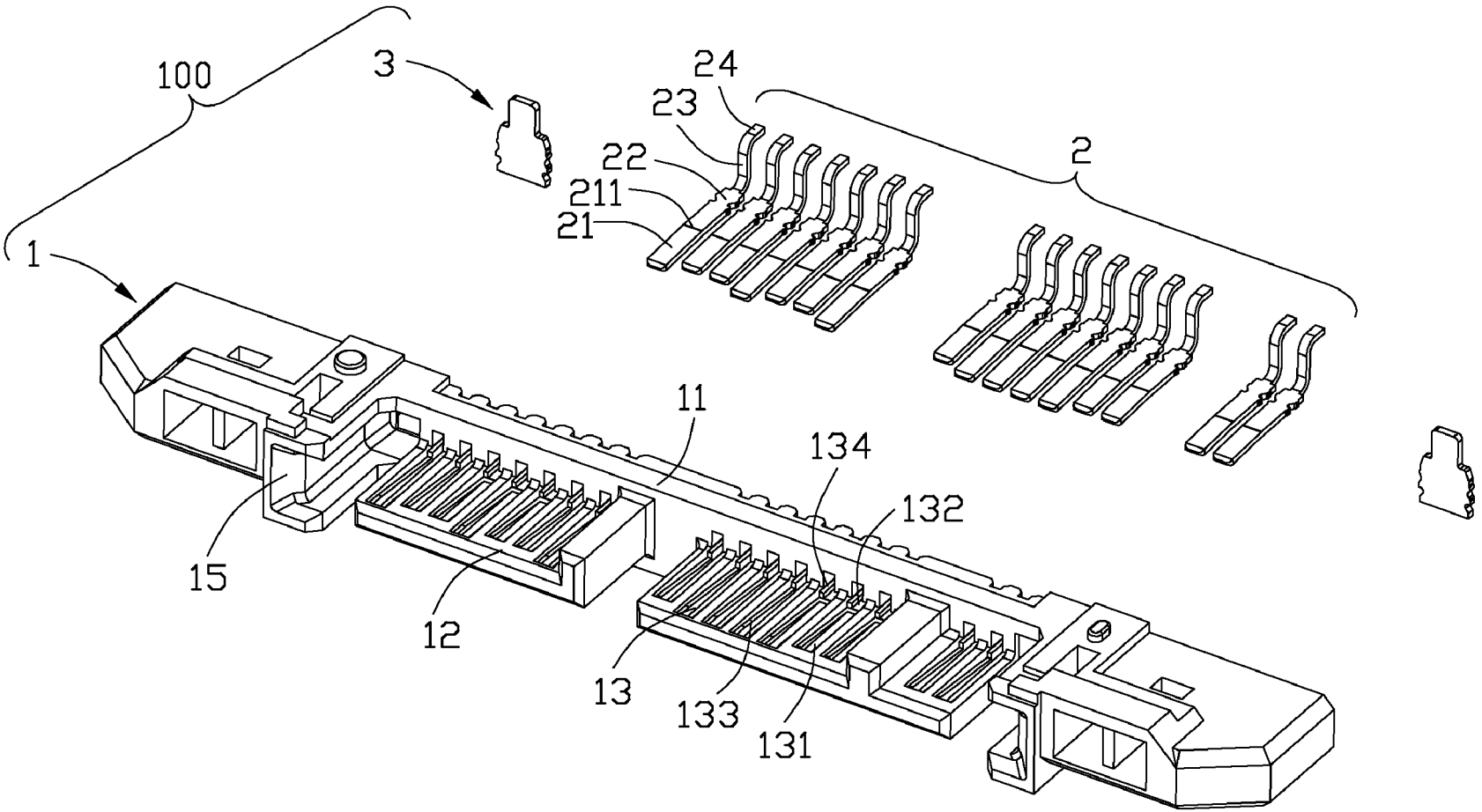
FIG. 4 is an exploded perspective view of the electrical connector of FIG. 2.

Referring to FIG. 1, an electrical connector 100 made in accordance with the present invention includes a rectangular insulating housing 1 with a plurality of terminals 2 arranged therein and a pair of metal locks 3 retained on two opposite ends of the housing. Referring to FIG. 2 through FIG. 4, the insulating housing 1 includes a rear base portion 11, two parallel and spaced tongue portions 12 extending forwards from a front face of the base portion 11. Two guiding walls 15 are located to couple with the tongue portion to define a mating cavity (not labeled) with the tongue portion 11. A plurality of passageways 13 on the bottom mating surface 121 of the tongue portions 12 extend from a position near the front edge of the tongue portion 12 rearwards through the rear face of the base portion 11. The passageway 13 includes a first segment 131 defined in the tongue portion 11 and a second segment 132 in the base portion 11. The underside surfaces A of said two segments 131, 132 are on a same level.

Figure 7:
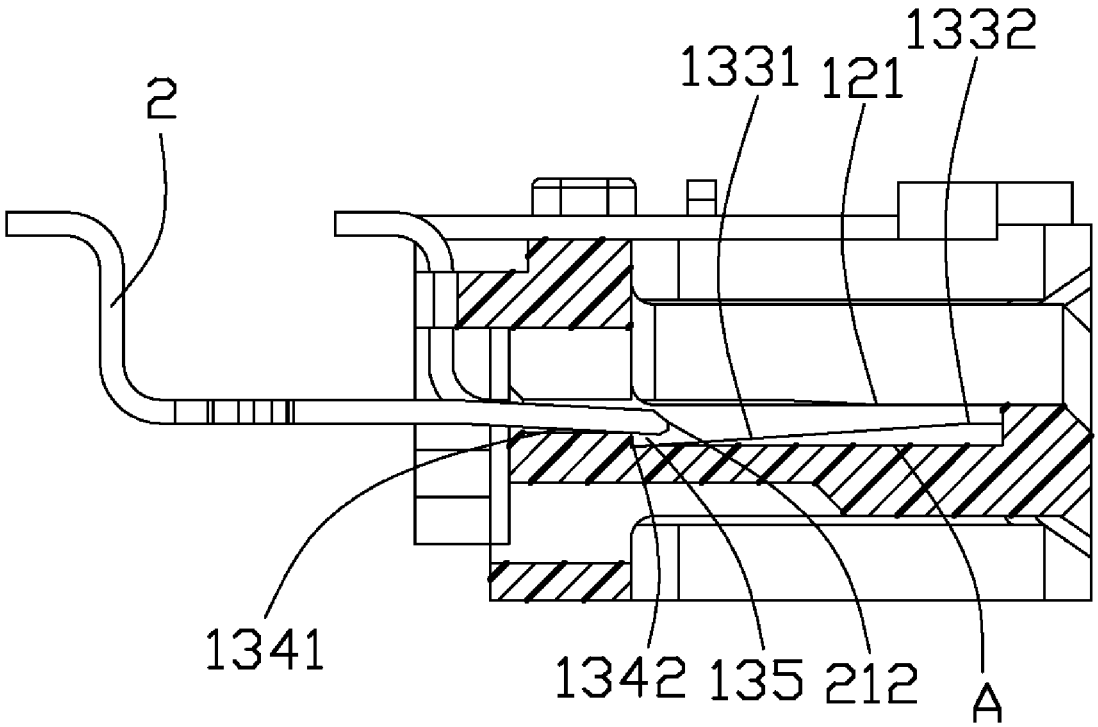
FIG. 7 is a cross-section view of the electrical connector to show half insertion statue of the terminal to the passageway.
Figure 8:
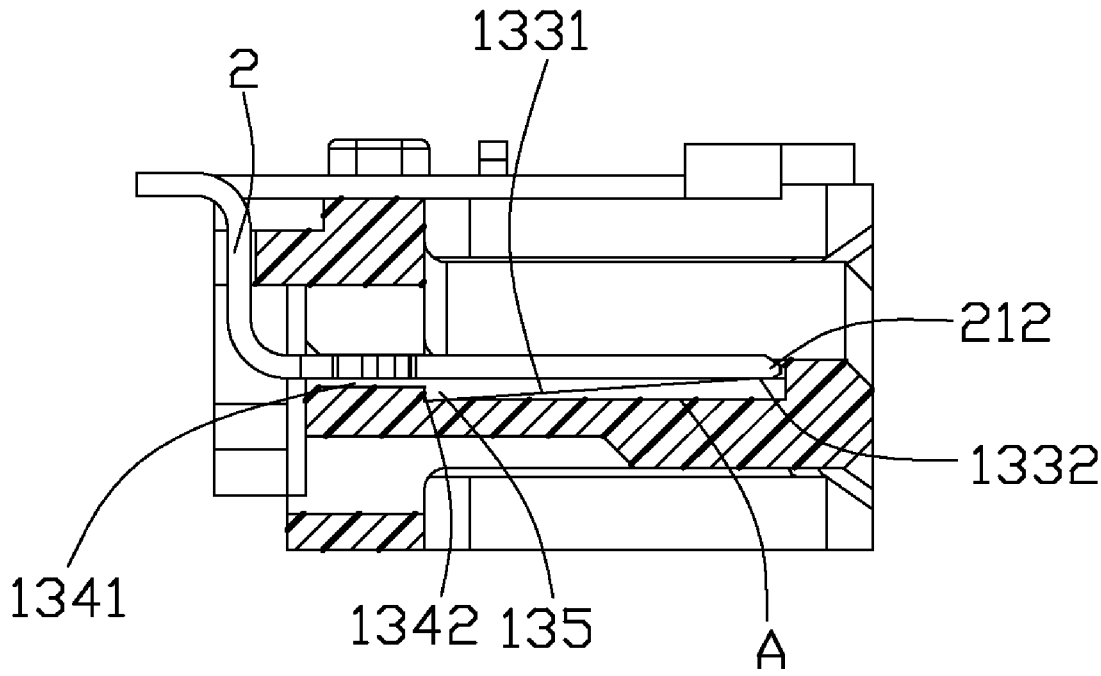
FIG. 8 is a cross-section view of the electrical connector show complete insertion statue of the terminal to the passageway.

Combination with FIG. 7, the first segment 131 projects two guiding rib 133 at two sides thereof from the underside surface A, which has a slanting upward guiding surface 1331 from the underside surface A. The second segment 132 projects two ramps or supporting rib 134 at two sides thereof, which has a horizontal second supporting surface 1341 parallel to the underside surface A thereof The slating upward guiding surfaces 1331 of guiding ribs 133 start near to the supporting ribs 134 and then slant upwards with a slight angle until at a high tip equal to the second supporting surface 1341. A horizontal supporting surface 1332 continue the guiding surface 1331. A room 135 is defined among a front face 1342 of the supporting rib 1342, the underside surface A and the guiding surface 1331 which is below the supporting surfaces 1332, 1341.

The terminal 2 includes a plane contacting portion 21, a leg portion 23 and a retaining portion 22 connecting with the contacting portion and the leg portion at opposite two ends of the retaining portion. The retaining portions 22 are received in the second segment 132 of the passageways 13 sustaining by the second supporting surface 1341 and have barbs at two sides thereof to interference with the side faces of the second segment 134. The leg portions 23 bent downward along the rear face of the base portion 11 and have horizontal soldering portions 24 at the free end of the leg portion 23 which is adapted for connecting to a PCB by SMT. The front half part of the contacting portion 21 bent to slant downward with a slight angle along a pre-fold line 211 to form a slanting downward front ends 212 or a downward-tilted tips.

Figure 5:
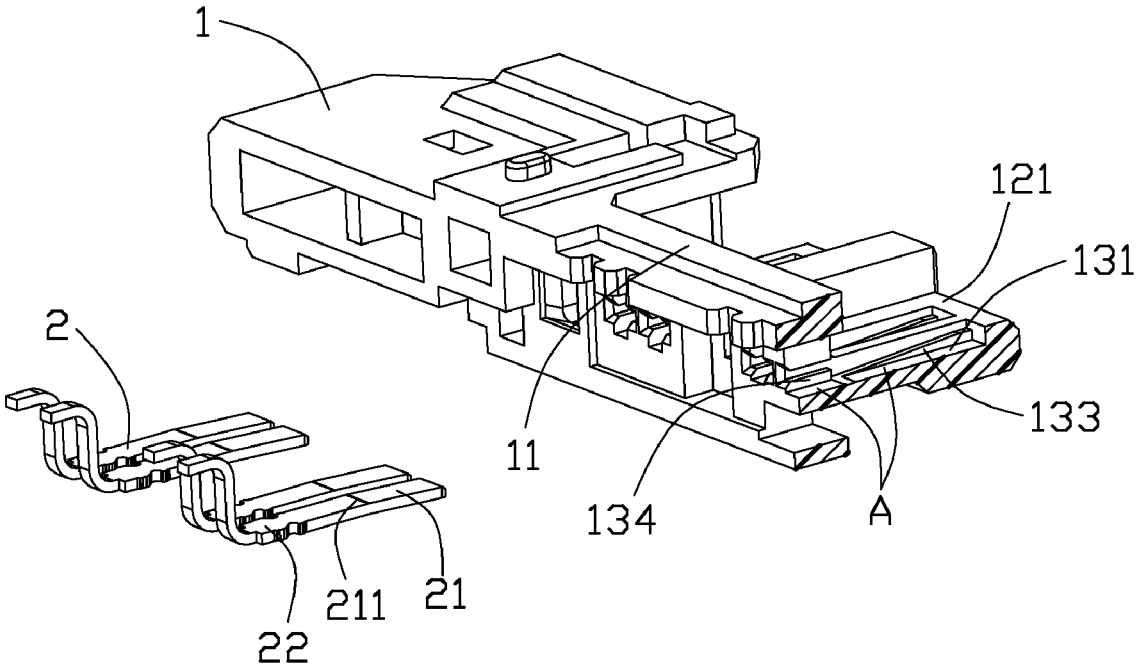
FIG. 5 is a perspective view of one part of the electrical connector cutting along line 6-6 in FIG. 2, before the terminals are inserted to the electrical connector.
Figure 6:
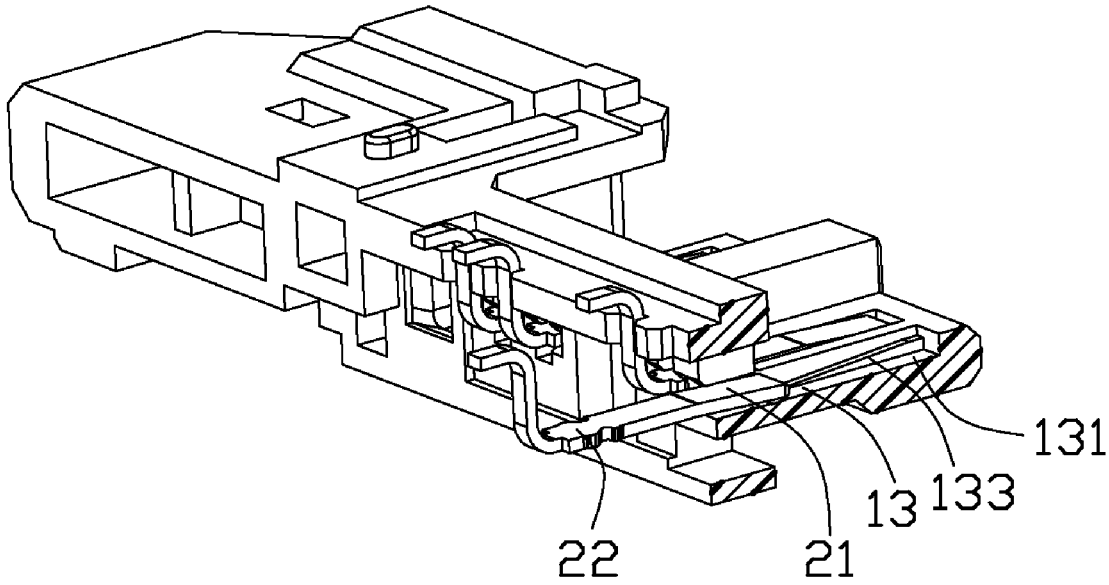
FIG. 6 is a perspective view of said one part of the electrical connector during the terminals are inserted to the electrical connector.

As best shown in FIGS. 5, 6 and 7 which illustrating the insertion process of the terminals 2, firstly, the contacting portions 1 run across the second segment 132 of the passageways 13 and partly into the first segment 131 wherein the slanting downward front ends 212 of the contacting portions 21 are received in the room 135. The front ends 212 of the contacting portion 21 follow forward and upward along the guiding surface 1331 until the front ends 212 arrive at the first supporting surface 1332. In a final statue, the front ends 212 have a tendency pressing against the first supporting surface 1332 and do not overstep the mating surface 121 of the tongue portion 12 to prevent from scraping against a counter connector (not shown) inserted in the electrical connector 100. The room 135 benefits the decrease of the friction force between the front ends 212 of the contacting portions 21 and the surface of the passageways 13. So the scrape is reduced. A recess is provided between said supporting ribs to not only decrease the friction of the terminal and the second supporting face 1342 but also meet electronic performance of the terminals.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector, comprising:

a plurality of terminals, each terminal comprising a retaining portion and a plane contacting portion, the contacting portion having a pre-folded line along which a front end of the contacting portion slants;

an insulating housing retained said plurality of terminals, the insulating housing comprising a base portion, a tongue portion extending forward from the base portion and passageways extending in the base portion and the tongue portion to receive the terminals;

each passageway defining a first supporting surface to sustain the front end of the terminal and a second supporting surface to sustain the retained portion of the terminal;

wherein a room is defined between said two supporting surface along a rear-to-front direction to accommodate the front ends of the terminals during insertion of the terminal to the passageway;

wherein the room is located below the first supporting face; wherein the first supporting surface and the second supporting surface is on a same level; wherein the passageway has a guiding surface extending from a bottom of the room to the first supporting surface; wherein said two supporting surfaces is disposed below a mating surface of the tongue portion which is engage with a counter connector which is inserted to the electrical connector; wherein the passageway includes a first segment defined on the tongue portion and a second segment defined on the base portion, the first segment defines a guiding ribs at two sides thereof and the first supporting surface and the guiding surface are on a top of the guiding ribs, and the second segment projects a pair of supporting ribs at two sides thereof and the second supporting surface is on a top of the supporting ribs.

2. An electrical connector comprising:

an insulative housing defining a mating tongue;

a plurality of passageways formed in a mating face of the mating tongue;

a plurality of contacts disposed in the housing, each of said contacts defining a horizontal main body with a contacting portion exposed upon the mating face, and a retaining portion located behind the contacting portion under condition that both said contacting portion and said retaining portion essentially extends in a horizontal mating direction with a front section of the contacting portion slightly urged toward the mating face; wherein the front section of the contacting portion is essentially sandwiched by the housing on two sides in a vertical direction perpendicular to said horizontal mating face, while a rear section of the contacting portion essentially abuts the housing on one side in said vertical direction; wherein said horizontal main body essentially retained to the housing by said retaining portion and the front section of the contacting portion in the corresponding passageway; wherein said housing defines a ramp in each of said passageways against which a front tip of the front section of the contacting portion abut during insertion of the contact into the passageway; wherein said ramp is formed on two lateral sides of the corresponding passageway; wherein said contacting portion is in a tensioned manner in said passageway with restored force in the vertical direction.

* * * * *